US007008264B2

(12) United States Patent
Wild

(10) Patent No.: US 7,008,264 B2
(45) Date of Patent: Mar. 7, 2006

(54) CONNECTOR FOR COAXIAL CABLE WITH ANNULARLY CORRUGATED OUTSIDE CONDUCTOR

(75) Inventor: Werner Wild, Buttenwiesen-Unterthürheim (DE)

(73) Assignee: Spinner GmbH, Munich (DE)

( * ) Notice: Subject to any disclaimer, the term of this patent is extended or adjusted under 35 U.S.C. 154(b) by 0 days.

(21) Appl. No.: 11/035,092

(22) Filed: Jan. 14, 2005

(65) Prior Publication Data

US 2005/0170693 A1 Aug. 4, 2005

(30) Foreign Application Priority Data

Jan. 29, 2004 (DE) ..... 10 2004 004 567

(51) Int. Cl.
*H01R 9/05* (2006.01)

(52) U.S. Cl. ..... 439/578

(58) Field of Classification Search ..... 439/578, 439/583, 584, 579

See application file for complete search history.

(56) References Cited

U.S. PATENT DOCUMENTS 6,133,532 A * 10/2000 Lundback et al. ..... 174/88 C
6,217,384 B1 4/2001 Strasser et al.

* cited by examiner

*Primary Examiner*—Phuong Dinh
(74) *Attorney, Agent, or Firm*—Edell, Shapiro & Finnan, LLC

(57) ABSTRACT

A connector for coaxial cables having an annularly corrugated outside conductor includes a connector head which includes a conical annular surface on the cable side which establishes contact on the inner side of the boundary face region of the outside conductor of the cable. A sleeve can be screwed onto the connector head. A radially elastic clamping ring is housed in a first inside groove in the sleeve, to which a second inside groove of smaller diameter is adjacent on the cable side. The transition between the two inside grooves is configured in such a way that the clamping ring is radially compressed during screwing of the sleeve onto the connector head and tensions the boundary face region of the outside conductor of the cable against the conical annular surface of the connector head.

9 Claims, 3 Drawing Sheets

CONNECTOR FOR COAXIAL CABLE WITH ANNULARLY CORRUGATED OUTSIDE CONDUCTOR

FIELD OF THE INVENTION

The invention relates to a connector for coaxial cables having an annularly corrugated outside conductor, comprising a connector head which comprises a conical annular surface on the cable side which is determined for establishing contact on the inner side of the boundary face region of the outside conductor of the cable, and further with a clamping element which encloses the outside conductor of the cable and can spring back in the radial direction and which in the mounted state is enclosed by a pressure member which can be screwed together with the connector head and is axially loaded in the direction towards the conical annular surface of the connector head, so that the boundary face region of the outside conductor of the cable is electrically contacted between the conical annular surface and a counter-surface of the clamping element and is mechanically clamped.

BACKGROUND

A connector of the aforementioned kind is disclosed in DE-C-198 57 528. The pressure member is preferably configured as a hollow screw which can be twisted into a recess of the connector head. It can also have the shape of a coupling sleeve which can be screwed onto the outside thread of the connector head. In both cases the clamping element consists of a contact sleeve which is subdivided into radially resilient segments by axial slots starting from its end on the insert side and being evenly distributed over the circumference and having enlarged heads on the cable side whose inner surfaces press in the mounted state the boundary face region of the annularly corrugated outside conductor of the cable against an annular surface, preferably a conical annular surface, of the connector head. In the embodiment of the pressure member as a hollow screw, a hollow in the connector head at the level of its annular surface and, in the embodiment of the pressure member as a coupling sleeve, a hollow in the latter, creates a cavity for allowing the heads of the contact sleeve to spring back when the connector is slid onto the cable. In both embodiments, annular shoulders arranged on the outside circumference of the contact sleeve and on the inner circumference of the pressure member cooperate in such a way that, before and during the mounting of the connector on the cable, the contact sleeve sits in the pressure member so as to be axially displaceable by one corrugation step, but during its final clamping with the connector head the boundary face region of the cable outside conductor is clamped between the annular surface of the connector head and the counter-surfaces of the enlarged heads of the contact sleeve. The clamping path is broken down into two sections by a sealing O-ring, of which the first corresponds to a pre-mounting state in which the complete connector can be slid onto the coaxial cable without being disassembled and without any extra parts (and can also be removed therefrom again, if necessary). For completing the mounting process, the pressure member needs only to be screwed together with the connector head over the length of the second clamping path section.

Connectors of this kind have comparatively high production costs. The main cause is to a considerable extent the illustrated contact sleeve. In order to house the same in the connector, it needs to have a minimum diameter that cannot be undercut and it must have a certain minimum length on the cable side. Moreover, the contact sleeve per se requires a large number of production steps.

SUMMARY

The invention is based on the object of providing a connector of the kind mentioned above which, by maintaining its disassembly-free mountability, can be produced in a more cost-effective manner.

An important aspect of the invention is to provide the clamping element as a slotted contact ring instead of a contact sleeve and to adjust the remaining construction in such a way that the contact ring fulfills the mechanical and electric function of the contact sleeve according to the state of the art. As a consequence, the outside diameter of the connector head decreases to approximately the value of the larger diameter of the conical annular surface, meaning that it is only slightly larger than the diameter of the outside conductor of the cable in the region of a peak of the corrugation. The contact ring is further completely housed in the interior of the pressure member configured as a sleeve with inside thread, which is in contrast to the contact sleeve of the known connector of this kind which projects at least partly in the disassembled state beyond the pressure member on the cable side. In particular, the contact ring is a simple turned part with respectively low production costs and of overall short length in comparison with a contact sleeve, so that the axial length of the threaded sleeve can be reduced considerably in comparison with the earlier configuration of the pressure member.

The clamping ring can have a cross section appropriately according to a triangle with a blunted tip. The clamping ring is therefore chamfered on its inner circumference, so that its profile better matches the corrugation profile of the outside conductor of the cable. As a result, it is possible to reduce the outside diameter of the clamping ring and thus also the dependent outside diameters both of the threaded sleeve as well as the connector head.

The transition between the larger diameter and the smaller diameter of the inner groove of the threaded sleeve can be provided with a conical configuration, either by a facet or by rounding off the cable-side flank of the inner groove with the larger diameter. Alternatively, the counter-surface of the clamping ring (on the cable side) can be provided with a facet or be rounded off. In both cases it is ensured that the threaded sleeve will increasingly compress the clamping ring in the radial direction during the further screwing onto the connector head (starting from the pre-mounting state of the connector). It will increasingly compress the clamping ring in the radial direction and simultaneously slide it in the direction towards the conical annular surface of the connector.

Preferably, the connector head, axially spaced from its cable-side face surface by approximately half the distance between two successively following corrugation peaks of the outside conductor of the cable, comprises a circular annular shoulder according to a reduction of the inside diameter of the connector head from the diameter of the cable insulator to the value required for maintaining a constant corrugation resistance. The extent of this jump in diameter depends on the diameter of the inside conductor of the connector and the type of insulator between the latter and the inner wall of the connector head.

For sealing the inner space of the connector, the connector head can be provided on the insertion side of its outer thread with a circumferential groove whose depth is lower than the diameter of an O-ring inserted into the groove.

In particular, the circumferential groove can define a pre-mounting state in which the face edge of the sleeve on the insert side rests on the O-ring and the clamping ring which is received in the inner groove with the larger diameter leaves a circumferential gap for receiving the boundary face region of the outside conductor of the cable between its shoulder surface and the conical annular surface of the connector head.

The proposed construction of the connector permits in the case of certain standardized types (such as type 7-16) to adjust the outside diameter of the connector head to the inside diameter of the standardized screw cap on the insert side in such a way that the screw cap can be slid from the cable side onto the connector head. The screw cap will thus be situated on the screw head without any further mechanical measures in a non-losable manner, with the smallest inside diameter of the former being equal to the outside diameter of the latter plus a tolerance gap.

In order to seal the connector on its cable side, an elastic profile seal can be arranged in the sleeve, which seal comprises at least one annular lip which comes to lie in a corrugation valley of the outside conductor of the cable after the insertion of the connector and which after the clamping of the connector with the cable tightly encloses the outside conductor of the cable approximately at the level of the corrugation peak by screwing the threaded sleeve onto the connector head. The connector is reliably sealed relative to the cable without any additional parts. If this advantage is omitted, the sealing can also be produced in a conventional manner by means of an O-ring slid as a separate part onto the cable sheath or by injecting a polymerizing sealing mass.

Advantageously, the profile sealing is fixed in the sleeve in an interlocking way, e.g., by complementary profiling of the respective inner wall region of the sleeve and the outside circumference of the profile sealing. In particular, the profile sealing can be provided with a sleeve-like configuration and can comprise at least one further lip towards the cable side which is axially spaced from its lip, which further lip is intended for sealing contact on the cable sheath.

BRIEF DESCRIPTION OF THE DRAWINGS

The drawings show an embodiment of a connector in accordance with the invention in a schematic view and in a longitudinal sectional view, wherein like reference numerals in the various figures are utilized to designate like components, and wherein.

DETAILED DESCRIPTION

Figure 1:
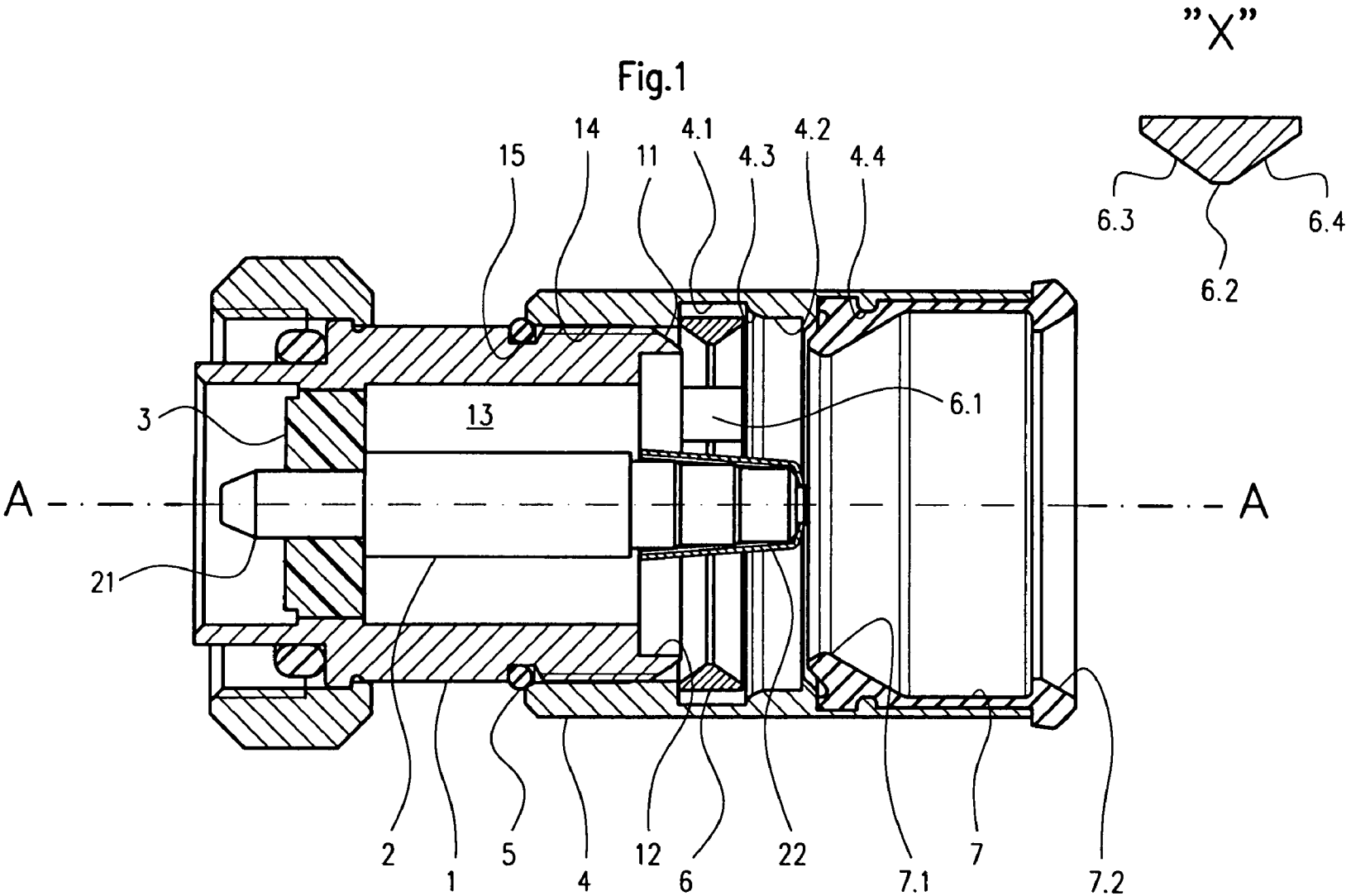
FIG. 1 shows the connector in the pre-mounting state, with an enlarged detail "X"

The connector as shown in FIG. 1 comprises a substantially hollow-cylindrical connector head 1 which encloses an inside conductor 2 of the connector, which conductor is held in an insulating material support 3. On the insertion side, the inside conductor comprises a contact pin 21 in this embodiment. The cable-side end of the inside conductor 2 is provided with a graduated tapering configuration for insertion into a tubular inside conductor 2 (also see FIG. 2) and carries a contact cup 22 which is slightly conical and is resilient in the radial direction. This configuration of the inside conductor of the connector is not part of the invention.

The connector head 1 ends on the cable side in a conical annular surface 11 which, starting from the cylindrical circumferential surface of the connector head 1, lies on the jacket of an imaginary cone whose tip rests on the cable side of the connector head 1 on its longitudinal axis A—A shown in the broken line. The circumferential surface of a hollow 12 is adjacent to the radially internal blade-like edge of the conical annular surface 11, which hollow has a larger diameter than the adjacent cylindrical inner space 13 of the connector head 1. The diameter of the hollow 12 is substantially equivalent to the diameter of the cable insulator (cf. FIG. 2). The connector head 1 comprises on the outside an outside thread 14 which is adjacent to the conical annular surface and which reaches up to a groove 15 in which an O-ring 5 is inserted whose diameter in the unloaded state is slightly larger than the depth of the groove 15.

In the illustrated pre-mounting state, a threaded sleeve 4 which is provided with a respective inside thread is screwed onto the outside thread of the connector head 1 to such an extent that its face surface on the connector side rests just about on the O-ring 5. The threaded sleeve 4 comprises a first inside groove 4.1 whose flank on the insert side is situated in this pre-mounted state approximately at the level of the blade-like edge of the conical annular surface 11. The inside groove 4.1 converges into a second inside groove 4.2 with a smaller inside diameter. The transition is configured as a rounding 4.3.

A clamping ring 6 made of a spring-elastic metal alloy such as bronze is loosely situated in the inside groove 4.1. The clamping ring 6 is provided with a slot 6.1 at a location of its circumference. The slot can also extend in an inclined way instead of being straight as shown in the drawing, e.g., under an angle of 45° relative to the longitudinal axis A—A of the connector. The clamping ring 6 has a slightly triangular cross section, with an inwardly facing tip which is broken by a chamfer 6.2 (cf. detail "X").

The threaded sleeve 4 has an enlarged inside diameter from the cable side of the inside groove 4.2 and a re-entrant ring collar 4.4 for receiving in an interlocking manner a sleeve-like profile seal 7 which is arranged at its insert side as a re-entrant ring lip 7.1 and on its cable-side end at a re-entrant ring lip 7.2.

Figure 2:
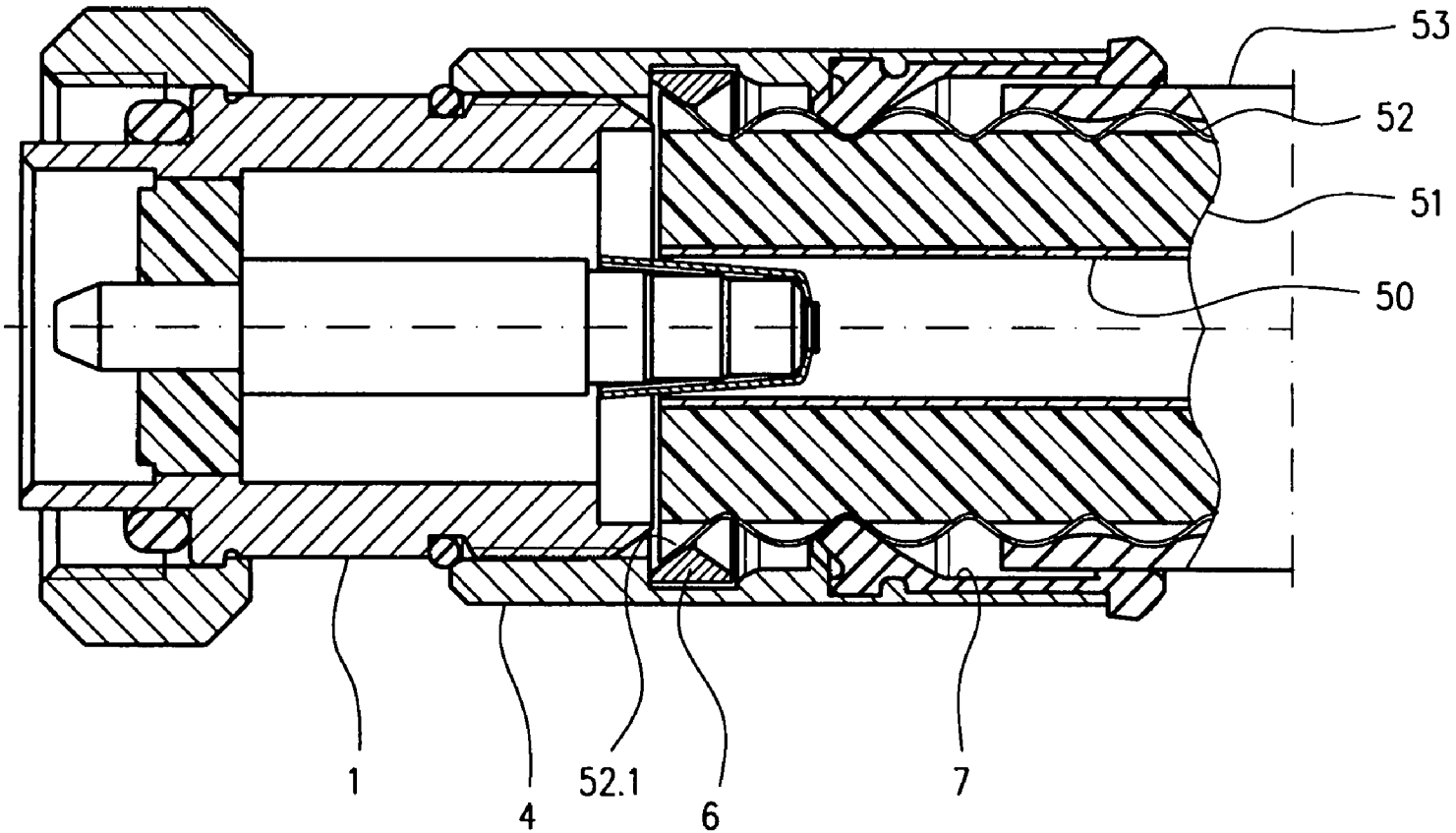
FIG. 2 shows the same connector after being slid onto the end of a coaxial cable.

FIG. 2 shows the same connector after being slid onto the end of the coaxial cable prepared in a fitting manner, which cable comprises a tubular inside conductor 50, a cable insulator 51, an annularly corrugated outside conductor 52 and a cable sheath 53.

The face edge 52.1 on the insert side of the cable which is offset (cut off) at the level of a corrugation peak of the outside conductor 52 can be slightly flanged up with a tool (not shown here). The face edge region of the outside conductor 52 assumes the illustrated position between the conical ring surface 11 of the connector head 1 and the conical counter-surface 6.3 of the clamping ring 6 after the face edge 52.1 has widened the same in the radial direction after running up against the conical annular surface 6.4 of the clamping ring 6 (cf. "X" in FIG. 1), so that the face edge of the outside conductor 52 can pass under the chamfer 6.2 of the clamping ring 6 or the clamping ring 6 was allowed to slide with its chamfer 6.2 over the face edge 52.1 of the outside conductor 52 during the sliding of the connector over the cable end. Before this, the face edge 52.1 of the outside conductor 52 has pushed the first lip 7.1 of the sleeve-like profile seal 7 radially to the outside and then the cable sheath 53 has pushed the second lip 7.2 radially to the outside. The surfaces of both lips of the profile seal 7 facing the cable are chamfered accordingly, meaning that they are configured in the manner of conical annular surfaces.

At the same time, inside conductor 2 of the connector enters with its cable-side end into the tubular inside conductor 50 which is contacted in the region of its face edge by the contact cup 22.

Figure 3:
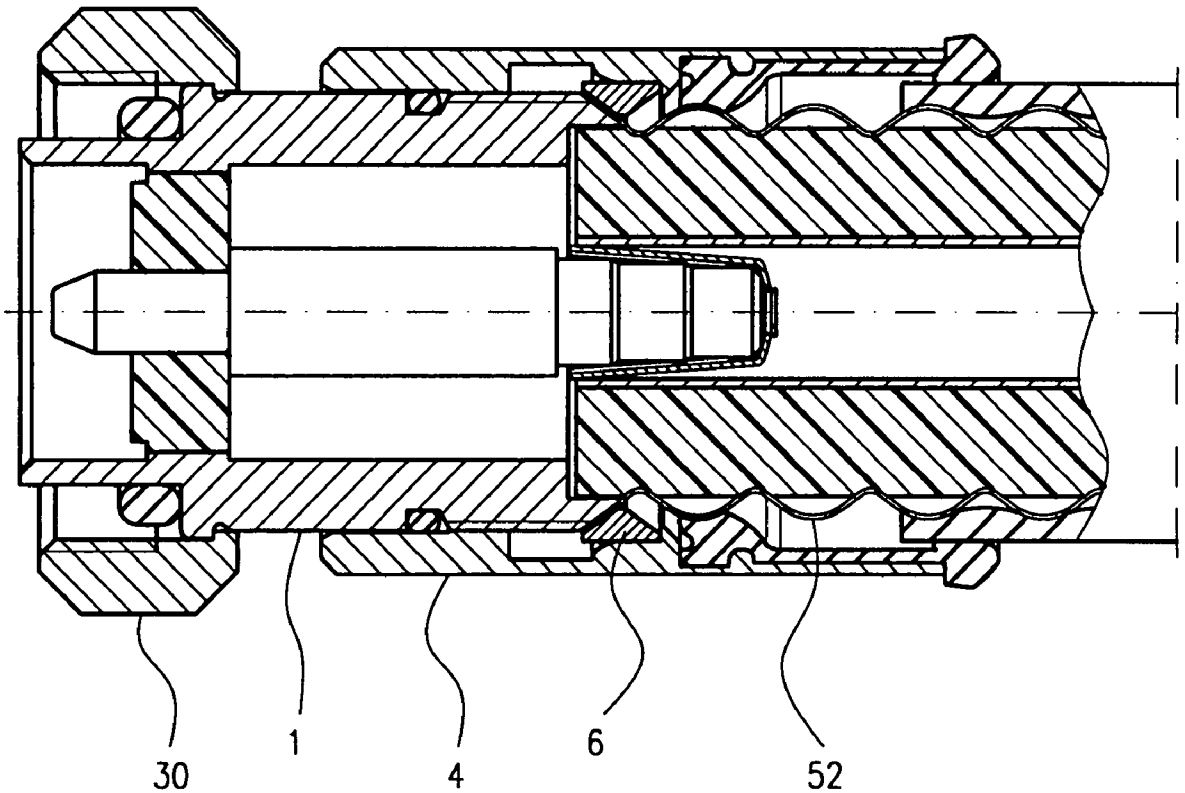
FIG. 3 shows the connector after completion of the mounting on the coaxial cable.

For the final mounting of the connector on the end of the coaxial cable, the threaded sleeve 4 is screwed beyond the O-ring 5 onto the connector head 1 until a predetermined tightening torque is reached. This completely mounted state is shown in FIG. 3.

While the threaded sleeve 4 is screwed onto the connector head 1, the rounding 4.3 has displaced the clamping ring 6 in the direction towards the connector head 1 and compressed the same simultaneously in the radial direction to such an extent that the second inner groove 4.2 now grasps beyond the clamping ring 6 and tightly encloses the same. With the last twists of the threaded sleeve 4, the cable-side flank of the inner groove 4.2 has come into contact with the cable-side edge of the clamping ring, which thus, compressed to the inside diameter as predetermined by the inside groove 4.2, is pressed in the axial direction with its surface 6.3 against the boundary face region of the outside conductor 52, as a result of which the latter is electrically contacted with the annular surface 11 of the connector head 1 and is clamped mechanically between the surfaces 11 and 6.3. In this state, the inside space of the connector is sealed on the one hand by the O-ring 5 and on the other hand by the lips 7.1 and 7.2 of the profile seal 7 which are compressed in the radial direction.

The proposed construction allows keeping the outside diameter of the connector of the standardized type 7-16 so small that a screw cap 30 with the standardized dimensions can be slid from the cable side onto the connector head 1 and can also be held in a non-losable manner on the cable side thereafter by screwing on the threaded sleeve 4 without requiring any further mechanical securing measures, which is in contrast to connectors of the same type of conventional design in which the connector head, as a result of its design, has a larger outside diameter, so that it needs to be provided with a circumferential groove at the level of the screw cap and an inside collar needs to be formed on the screw cap by rolling the same into the circumferential groove.

Having described preferred embodiments of new and improved coaxial cable connector, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A connector for a coaxial cable that has an annularly corrugated outside conductor, comprising:

a connector head which comprises a conical annular surface on a cable side end of the connector head, the conical annular surface establishing contact on an inner side of a boundary face region of the outside conductor of the coaxial cable, the connector head further comprising an outside thread;

a clamping element that encloses the outside conductor of the coaxial cable, the clamping element being capable of springing back in the radial direction; and a pressure member comprising a sleeve with an inside thread that engages the outside thread of the connector head, such that the pressure member screws together with the connector head, the pressure member enclosing the clamping element in a mounted state, wherein the clamping element is axially loaded in a direction towards the conical annular surface of the connector head, so that the boundary face region of the outside conductor of the cable is electrically contacted and is mechanically clamped between the conical annular surface and a counter-surface of the clamping element, wherein:

the clamping element comprises a clamping ring that is open on one side and that sits in a graduated inside groove of the sleeve, which inside groove has on an insertion side a first larger diameter and on the cable side a second smaller diameter, wherein the clamping ring has a cross section according to a triangle with a blunted tip; and a transition between the first and second diameters of the graduated inside groove is configured to cooperate with a cable-side face edge of the clamping ring, such that the clamping ring tensions against the conical annular surface of the connector head during screwing of the sleeve onto the connector head under radial compression of the boundary face region of the outside conductor of the coaxial cable.

2. The connector according to claim 1, wherein the transition between the first larger diameter and the second smaller diameter of the inside groove is provided with a conical configuration.

3. The connector according to claim 1, wherein the connector head is axially spaced from its cable-side face surface by approximately half the distance between two successively following corrugation peaks of the outside conductor of the cable, a wherein the connector head further comprises a circular annular shoulder according to a reduction of the inside diameter of the connector head from a diameter of a cable insulator to a value required for maintaining a constant corrugation resistance.

4. The connector according to claim 1, wherein the connector head comprises, on the insertion side of its outside thread, a circumferential groove, the connector further comprising an O-ring inserted into the circumferential groove, wherein a depth of the circumferential groove is less than the diameter of the O-ring.

5. The connector according to claim 4, wherein the circumferential groove defines a pre-mounting state in which a face edge of the sleeve on the insertion side rests on the O-ring, and the clamping ring, which is received in the inside groove with the first larger diameter leaves a circumferential gap for receiving the boundary face region of the outside conductor of the coaxial cable between the counter-surface of the clamping ring and the conical annular surface of the connector head.

6. The connector according to claim 1, further comprising a screw cap seated in a non-losable way on the connector head, the screw cap having a smallest inside diameter approximately equal to the outside diameter of the connector head.

7. The connector according to claim 1, further comprising an elastic profile seal arranged in the sleeve, the elastic profile seal comprising at least one annular lip that lies in a corrugation valley of the outside conductor of the coaxial cable after insertion of the connector on the coaxial cable, wherein, after clamping of the connector with the coaxial cable, the elastic profile seal tightly encloses the outside conductor of the coaxial cable approximately at the level of a corrugation peak by screwing the sleeve onto the connector head.

8. The connector according to claim 7, wherein the elastic profile seal is fixed in the sleeve in an interlocking manner.

9. The connector according to claim 7, wherein the elastic profile seal includes a sleeve-like configuration and, axially spaced from its lip towards the cable side, comprises at least one further lip configured to provide a sealing contact on a cable sheath.

* * * * *